US011535413B2

(12) United States Patent
Niehoff et al.

(10) Patent No.: US 11,535,413 B2
(45) Date of Patent: Dec. 27, 2022

(54) VACUUM DRUM FOR A LABELING UNIT, AND LABELING UNIT HAVING A VACUUM DRUM OF THIS TYPE

(71) Applicant: KHS GmbH, Dortmund (DE)

(72) Inventors: Patrick Niehoff, Bochum (DE); Gerhard Klöpper, Hamburg (DE); Lutz Deckert, Haltern am See (DE); Daniel Schleweis, Hamburg (DE)

(73) Assignee: KHS GmbH, Dortmund (DE)

( * ) Notice: Subject to any disclaimer, the term of this patent is extended or adjusted under 35 U.S.C. 154(b) by 126 days.

(21) Appl. No.: 17/287,176

(22) PCT Filed: Nov. 28, 2019

(86) PCT No.: PCT/EP2019/082849
§ 371 (c)(1),
(2) Date: Apr. 21, 2021

(87) PCT Pub. No.: WO2020/109441
PCT Pub. Date: Jun. 4, 2020

(65) Prior Publication Data

US 2021/0380303 A1 Dec. 9, 2021

(30) Foreign Application Priority Data

Nov. 29, 2018 (DE) ..... 10 2018 130 318.1

(51) Int. Cl.
*B65C 9/18* (2006.01)
*B65C 9/22* (2006.01)

(52) U.S. Cl.
CPC ..... *B65C 9/1819* (2013.01); *B65C 9/2256* (2013.01); *Y10T 156/1033* (2015.01)

(58) Field of Classification Search
CPC combination set(s) only.
See application file for complete search history.

(56) References Cited

U.S. PATENT DOCUMENTS

| | | | | | |
|---|---|---|---|---|---|
| 3,864,187 | A * | 2/1975 | Carter | B65C 9/14 | 156/364 |
| 4,032,388 | A | 6/1977 | Dunning | | |
| 4,354,887 | A * | 10/1982 | Total | B65C 3/14 | 156/64 |
| 4,735,668 | A * | 4/1988 | Hoffmann | B65C 3/16 | 156/215 |
| 4,801,348 | A | 1/1989 | Takagaki | | |
| 5,344,519 | A | 9/1994 | Galchefski et al. | | |
| 2018/0186493 | A1* | 7/2018 | Hafner | B29C 66/92 | |

FOREIGN PATENT DOCUMENTS

| | | | |
|---|---|---|---|
| CN | 101600624 | A | 12/2009 |
| DE | 102006051359 | A1 | 4/2008 |
| DE | 102015214011 | A1 | 1/2017 |
| EP | 0261861 | A2 | 3/1988 |
| EP | 1052209 | A1 | 11/2000 |

* cited by examiner

*Primary Examiner* — Carson Gross
(74) *Attorney, Agent, or Firm* — Occhiuti & Rohlicek LLP

(57) ABSTRACT

A vacuum drum for container labeling includes vacuum holders for holding a label. Each holder has a bistable rotational switch that switches between operating positions as a result of its switch actuator interacting with stationary switches during the drum's rotation. In one operating position, a label receives glue from a glue station. In the other, the holders avoid engagement with the glue station.

20 Claims, 10 Drawing Sheets

VACUUM DRUM FOR A LABELING UNIT, AND LABELING UNIT HAVING A VACUUM DRUM OF THIS TYPE

RELATED APPLICATIONS

This is the national stage under 35 USC 371 of international application PCT/EP2019/082849, filed on Nov. 28, 2019, which claims the benefit of the Nov. 29, 2018 priority date of German application 10-2018-130-318.1, the contents of which are herein incorporated by reference.

FIELD OF INVENTION

The invention relates to a vacuum drum for a labelling unit and to a labeling device that includes such a drum. The present invention further relates to a labelling device having a vacuum drum of this type.

BACKGROUND

In a labeling machine for labeling containers, a vacuum drum holds a label at the label's leading and trailing edge and applies the label to the container, for example by rotating the container and thus removing the label from the drum.

A typical vacuum drum has a pair of vacuum holders spaced apart by the length of the label along the drum's surface. As a rule, there exist several such vacuum holders so that each rotation of the drum can label several containers. In operation, as the drum spins, the label passes by a gluing station, which applies glue to the label. As the drum continues to spin, it applies that label, which has had glue applied to it, to a container.

As a result of gaps in container flow, there are times when some of the vacuum holders should avoid carrying a label. As the vacuum holders pass by the gluing station, it is useful to avoid having glue applied to the vacuum holders. This is carried out by switching the holders in and out of a working position.

Known holders rely on a stationary switching unit with displaceable control curves beneath the vacuum drum. This interacts with control rollers coupled to the vacuum holders to switch them into a position in which they can avoid a glue application. A roller mechanism permits switching the control curves. This permits rapid switching. But the high switching forces required cause loud noise and considerable wear on the switching mechanism.

SUMMARY

An object of the invention is that of providing a vacuum drum for a labeling unit that avoids the aforementioned disadvantages and that allows for correspondingly improved machine operation in the event of gaps in the container flow.

In one aspect, the invention features a vacuum drum for a labeling unit of a labeling machine, in particular for the labeling of containers or the like, comprising at least one vacuum holder pair, which can be rotated in a direction of rotation about a drum axis of the vacuum drum, and which comprise at least two vacuum holders, provided at a circumferential surface of the vacuum drum and offset against one another in the direction of rotation. In this situation, a front vacuum holder, related to the direction of rotation, is provided for holding a respective front label end of a corresponding label, and a rear vacuum holder, related to the direction of rotation, for holding a rear label end pertaining to it, provided at the circumferential surface of the vacuum drum. The front and rear vacuum holders of the at least one vacuum holder pair each comprise a rotational switch which can be switched into two fixed stationary operating positions, with at least one switch actuator. Moreover, by means of the respective rotational switch the front and rear vacuum holders are configured such as to be switchable between an inner maintenance position, as a first fixed operational position, in which the at least one vacuum holder pair can be led, free of contact, past a gluing unit provided next to the vacuum drum, and an outer working position, as a second fixed operational position, in which the at least one vacuum holder pair can be led past the gluing unit with contact, in that the respective switch actuator of an associated rotational switch can be brought into active engagement with at least two stationary switches, in order to initiate the switching movements.

The vacuum drum according to the invention accordingly represents a bistable system, which, in the respective inner maintenance position as well as in the outer working position, forms a respective fixed, i.e. in particular self-holding, stationary operational position, without the need thereby for a switching roller of a roller switching device to be held or guided. By means of the configuration according to the invention of the vacuum drums, it is therefore only necessary for them to be switched at changes of state, i.e. in particular in the event of position gaps occurring in the container transport, or when a container flow is restored after an extended gap with several containers missing. This reduces the number of switching procedures in the event of more substantial position gaps occurring, with several containers missing.

Preferably, the respective switch actuator can be configured as rotationally symmetrical, for example as a switching bolt, which is switched by means of the rotational switch. As an alternative, the respective switch actuator can also be configured in the form of a switching tag, wherein the switching tag preferably exhibits such an outer configuration that the switching tag can be actuated with particularly low noise by the actuating device assigned to it. For example, the switching tag can exhibit an at least partially convex outer contour.

Preferably, however, the respective switch actuator is configured as a switching roller, and for particular preference as a freely rotatable switching roller. As a result of the configuration as a switching roller, a particularly abrasion-free and/or low noise operation of a vacuum drum according to the invention is possible, which in practice is particularly desirable.

It is further likewise possible for the respective switch actuator consists at least partially of a plastic material.

It is further likewise possible for the respective switch actuator to be configured as an insertable sleeve, not capable of rotational movement, wherein this preferably consists of a particularly abrasion-resistant plastic or metal material.

According to one advantageous embodiment variant, provision is made for the vacuum drum to be formed as multi-part, with several segments arranged about the drum axis, wherein each segment comprises in turn at least one vacuum holder pair, with front and rear vacuum holders, separate from one another and capable of being switched into the first and/or second fixed stationary operational position by means of the associated rotational switch.

In some embodiments, provision is made for a front vacuum pad to be provided at the front vacuum holder, which, by means of the front rotational switch assigned to the front vacuum holder, is configured so as to be switchable between the outer working position and the inner maintenance position, and that a rear vacuum pad is provided at the rear vacuum holder, which, by means of the rear rotational switch of the rear vacuum holder, is configured so as to be switchable between the outer working position and the inner maintenance position.

In some embodiments, provision is made for the corresponding rotational switch in each case to comprise an essentially U-shaped carrier element, between the side limbs of which a pivot axis extends, oriented parallel or essentially parallel to the drum axis and rotatable, securely arranged at which are at least two rocker levers, spaced apart along the pivot axis.

In some embodiments, provision is made for the rocker levers to comprise a first and second switching surface, which in each case interact with a punch, pre-tensioned under spring force, which is guided in an axially displaceable manner in the base limb which connects the two side limbs of the U-shaped carrier element, and wherein the respective punch is securely connected on its side opposite the rocker levers to a corresponding front or rear nozzle body, to which the respective vacuum pads are assigned.

In some embodiments, provision is made for the at least two rocker levers, securely connected to the pivot axis, are configured such as to be capable of pivoting to-and-fro between the first and second stationary operational positions, and specifically in such a way that the first stationary operational position is arranged at the first switching surface and the second stationary operational position is arranged at the second switching surface of the corresponding rocker lever.

In some embodiments, provision is made for the at least two rocker levers to be configured such as to be switchable into the first fixed stationary operational position in such a way that the associated front and rear vacuum pad is held securely stationary in the maintenance position, and that the at least two rocker levers are configured so as to be capable of being switched into the second fixed stationary operating position in such a way that the associated front and rear vacuum pad is held stationary and fixed in the working position.

In some embodiments, provision is made that, by the initiation of a pivoting movement by the respective switch actuator, by means of the at least one stationary switch the associated pivot axis can be rotated, and, by means of the switching surfaces provided at the rocker lever, the associated punches can be moved radially outwards or inwards respectively, seen from the drum axle, such that the respective front or rear rotational switch is switched into its first or second fixed stationary operational position.

In some embodiments, provision is made for the respective front switch actuators of the associated front vacuum holders to be provided on the free end side in a common height plane, and the respective rear switch actuators of the associated rear vacuum holders to be provided on the free end side in a common height plane, wherein the one height plane is configured as being at a further spacing distance from a base carrier than the other height plane.

In some embodiments, provision is made for the respective stationary switch to comprise in each case a pivotable lever, with at least one control surface for initiating a switching movement of the respective front and/or rear rotational switch by means of their respective switch actuator.

In some embodiments, provision is made for a first, a second, and a third stationary switch to be provided, wherein the first switching device comprises a first pivotable lever with a first control surface, the second switching device comprises a second pivotable lever with a second control surface, and the third switching device comprises a third pivotable lever with a third and a fourth control surface.

In some embodiments, provision is made for the first stationary switch to be configured in such a way as to press the switch actuator of a corresponding front vacuum holder, in each case rotating about the drum axis, in the direction of rotation of the first switching device, by means of the first control surface from the outside inwards in the direction of the drum axis, such that the front rotational switch can be switched into the first stationary operational position, in which the front vacuum holder is located in the maintenance position.

In some embodiments, provision is made for the second stationary switch to be configured such as to press that rear switch actuator of a corresponding rear vacuum holder, in each case rotating past about the drum axis in the direction of rotation at the second switching device, by means of the second control surface from the outside inwards in the direction of the drum axis, such that the rear rotational switch can be switched into the first stationary operational position, in which the rear is located in the maintenance position.

In some embodiments, provision is made for the third stationary switch is configured such as to press the front and rear switch actuators of a corresponding front and rear vacuum holder, in each case rotating past about the drum axis in the direction of rotation at the third switching device, by means of the third and fourth control surfaces, from the inside outwards, directed radially away from the drum axis, such that the front and rear rotational switches can in each case be switched into the second stationary operational position, in which the front and rear vacuum holders are located in the working position.

The expression "essentially" or "approximately" signifies in the meaning of the invention deviations from the exact value in each case by +/−10%, preferably by +/−5%, and/or deviations in the form of alterations which are not of significance for the function.

Further embodiments, advantages, and possible applications of the invention are also derived from the following description of exemplary embodiments and from the Figures. In this situation, all the features described and/or represented as images are in principle the object of the invention, alone or in any desired combination, regardless of their summary in the claims or reference to them. The contents of the claims are also considered a constituent part of the description.

Although some aspects have been described in connection with a device, it is understood that these aspects also represent a description of the corresponding method, such that a block element or a structural element of a device is also to be understood as a corresponding method step or as a feature of a method step. By analogy, aspects which have been described in connection with or as a method step also represent a description of a corresponding block or detail or feature of a corresponding device. Some or all of the method steps can be carried out by a hardware device (or with the use of a hardware device), such as, for example, a microprocessor, a programmable computer, or an electronic circuit. In some exemplary embodiments, some or numerous most important method steps can be carried out by such a device.

BRIEF DESCRIPTION OF THE FIGURES

These and other features of the invention will be apparent from the following detailed description and the accompanying figures, in which.

Identical reference numbers are used in the figures for elements of the invention which are the same or have the same effect. Moreover, for easier overview, only reference numbers are shown in the individual Figures which are required for the description of the respective figure. In the figures, also, the invention is only represented in schematic views to explain the mode of operation. In particular, the representations in the figures serve only to explain the underlying principle of the invention. For reasons of easier overview, the representation of all the constituent parts of the device has been avoided.

DETAILED DESCRIPTION

Figure 1:
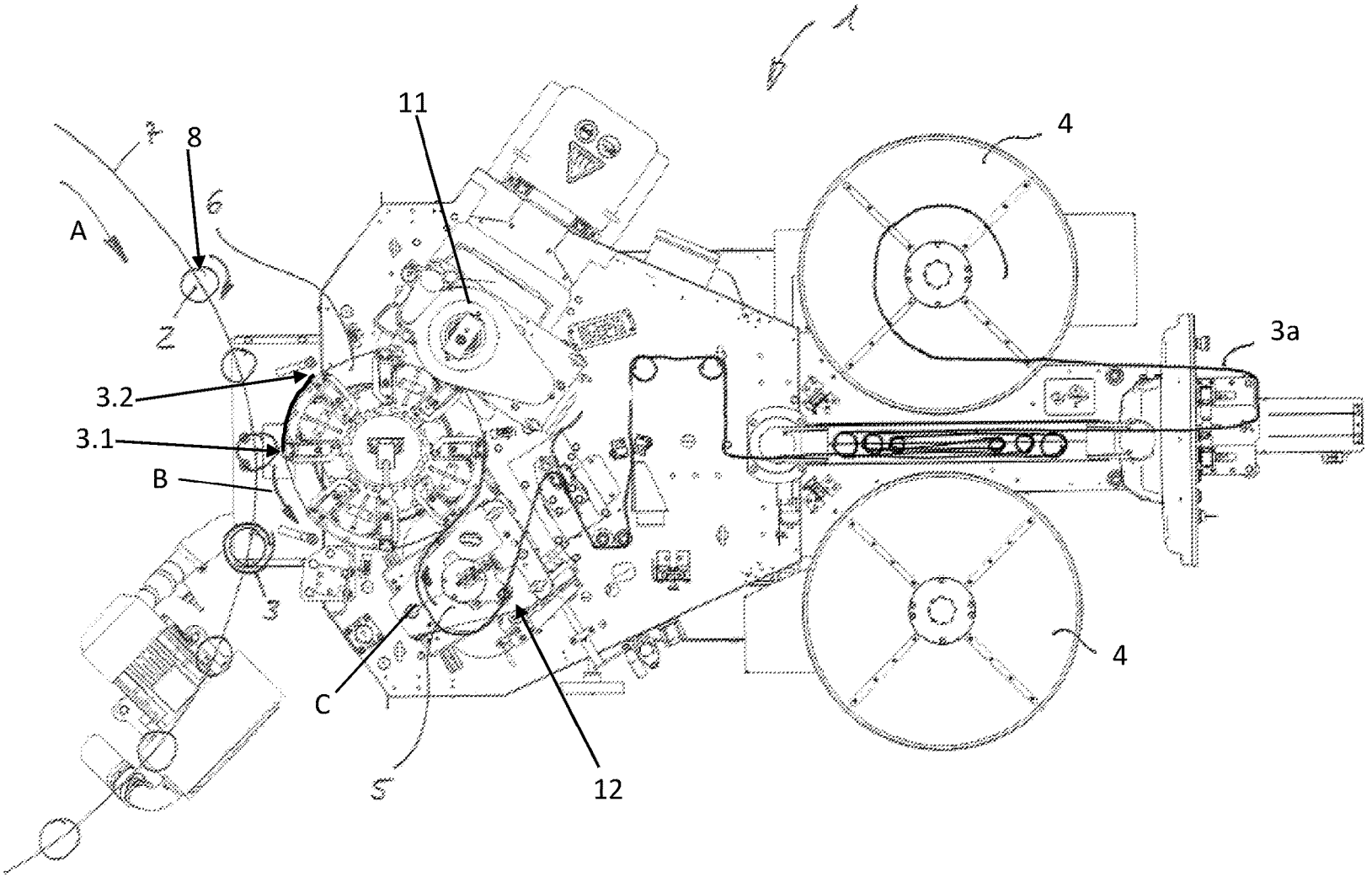
FIG. 1 is a view from above a labeling unit of a labeling machine for labeling containers.

FIG. 1 shows a labeling unit 1 of a labeling machine for the labeling of bottles or similar containers 2 with roll-fed labels 3. The labels 3 are drawn off a supply roll 4 that supplies an endless strip of label material 3*a*. The labeling unit 1 includes a cutter 5 that cuts the label material 3*a* into a length that is required for a label 3.

The labeling machine 1 also includes a vacuum drum 6. The vacuum drum 6 transfers the label 3 onto a container 2 as the container is being moved past on a rotor 7 that is moving in a first direction A. Meanwhile, the vacuum drum 6 rotates in a second direction B.

Conveyor rollers draw the label material 3*a* off the supply roll 4 consistent with the first direction A and convey it to the cutter 5.

The cutter 5 comprises a cutting drum 12, that, during the labeling operation, rotates about its vertical cutting-drum axis TA along a third direction C that is opposite the second direction B.

Rotating plates 8 along the rotor's circumference each support a standing container 2 that is to be labeled. A transporter, which has been omitted for clarity, receives containers 2, such as bottles, from a container inlet and transports them to the rotor 7, where they stand on the rotating plates 8. The rotor 7 moves the containers 2 past the labeling unit 1. The drum 6, which holds a label along a circumferential drum surface thereof with the label having had glue applied thereto, labels the container 2.

The drum 6 carries out the labeling by transferring a leading edge of the label onto the container 2 as the container 2 moves past. The rotating plate 8 then rotates the container 2, thus allowing it to draw the rest of the label from the drum 6. The newly-labeled container 2 then proceeds to a container outlet to be received at another transporter for further processing.

Front and rear holders 9.1, 9.2 form a vacuum-holder pair 9 that holds the edges of the label along the drum's surface during the foregoing operation. Each holders 9.1, 9.2 is a vacuum holder. The holders 9.1, 9.2 are spaced apart from each other along the circumferential direction by the length of the label. Since the drum rotates, one of these holders leads the other. The front holder 9.1 holds the label's leading edge and the rear holder 9.2 holds the label's trailing edge.

The labels 3 are cut and separated from an endless strip of labeling material 3*a* that has been wound onto a supply coil 4 to be drawn off for further processing as required. Motor-driven conveyor rollers convey this label material 3*a* to the labeling unit 1 and pass it by the cutting unit 5 to be cut as needed to form a label 3, to be separated from the strip. This label is then transferred to the vacuum drum 6.

Figure 7:
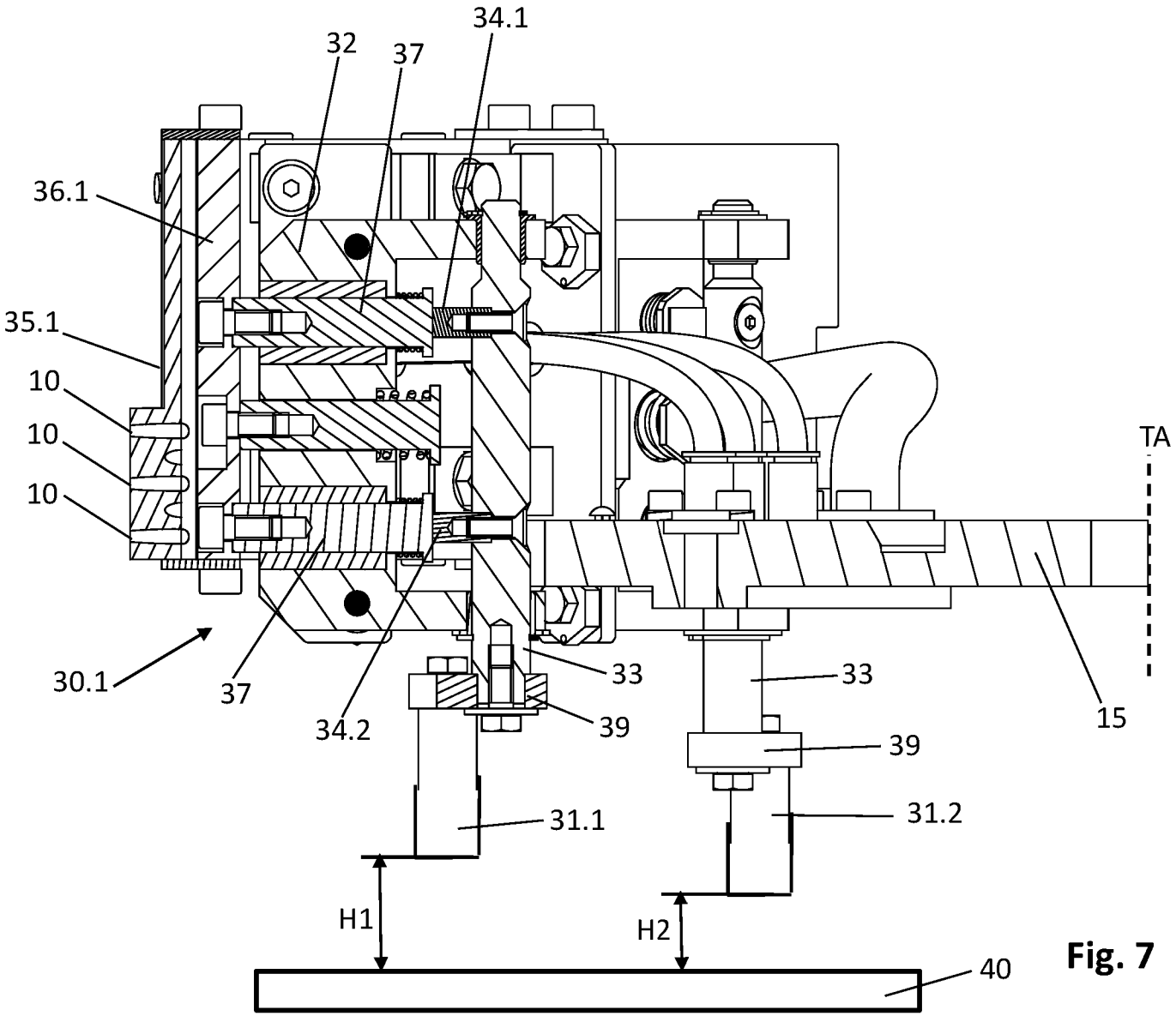
FIG. 7 is a sectional view of the drum shown in FIG. 6.

Referring to FIG. 7, the front holder 9.1 includes a front rotational switch 30.1 and the rear holder 9.2 includes a rear rotational switch 30.2. Each rotational switch 30.1, 30.2 has a corresponding switch actuator 31.1, 31.2 that causes the rotational switch 30.1, 30.2 to transition between two operating positions BS1, BS2.

Each operating position BS1, BS2 is a fixed stationary operating position. The operating position is "fixed" because the rotational switch 30.1, 30.2 remains in that position until it is switched out of that position. The rotational switch 30.1, 30.2 is thus a bistable switch. The first operating position BS1 corresponds to an inner maintenance position WP and the second operating position BS2 corresponds to an outer working position AP.

In a preferred embodiment, the switch actuator 31.1, 31.2 comprises a component that is rotationally symmetric to an axis along which it extends. A suitable switch actuator 31.1, 31.2 comprises a bolt.

Referring back to FIG. 1, the labeling machine 1 includes a gluing station 11 having a glue roller that applies glue to labels. When the holder 9.1, 9.2 is in its working position AP, the holder pair 9 guides the label, which is being held by suction, against the glue roller at the gluing station 11. As a result, glue can be applied to the label. In contrast, a holder 9.1, 9.2 that is in its maintenance position WP can be led past the gluing station 11 without making contact. This is useful when the holder pair 9 is not carrying a label, for example as a result of a gap in the container flow.

The working position AP is thus the usual configuration during operation. The maintenance position WP, which is located radially inward from the working position AP, is a disengaged position. An empty holder pair 9, which is one that is not carrying a label, is temporarily switched into the maintenance position WP.

In the second fixed operating position BS2 of the rotational switch 30.1, 30.2, the front and rear vacuum holders 9.1, 9.2 are switched into their corresponding working positions AP. As a result, the holders 9.1, 9.2 hold a label 3 and guide it past the gluing station 11 so that the label can receive an application of glue.

Figure 2:
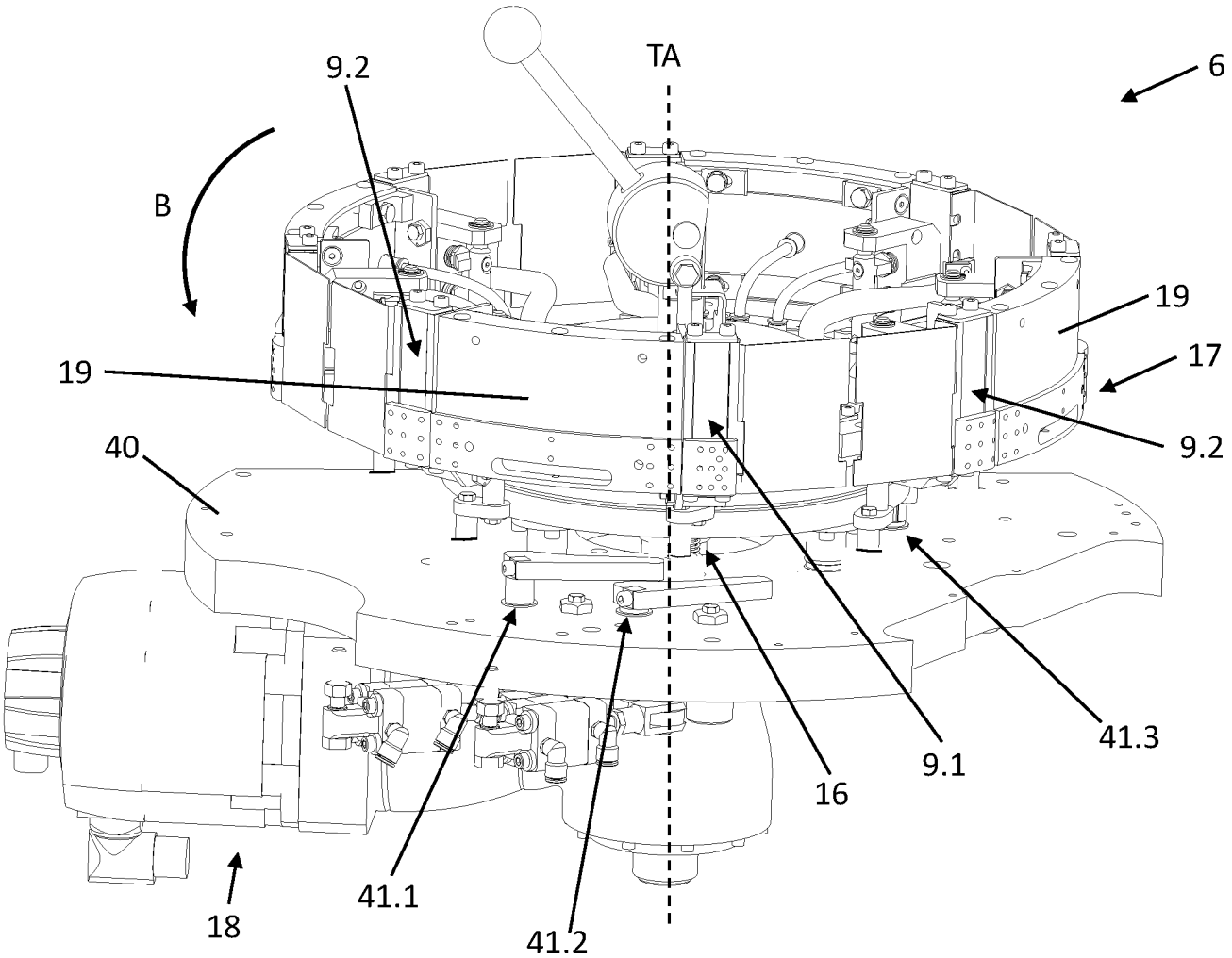
FIG. 2 is an isometric view of a vacuum drum used in the labeling machine of FIG. 1.

As shown in FIG. 2, the drum 6 comprises identical segments 17 arranged around the drum's axis TA. Each segment 17 includes a holder pair 9 having front and rear vacuum holders 9.1, 9.2. The front and rear vacuum holders 9.1, 9.2 switch between the two operating positions BS1, BS2 separately from each other using their corresponding rotational switches 30.1, 30.2.

Figure 3:
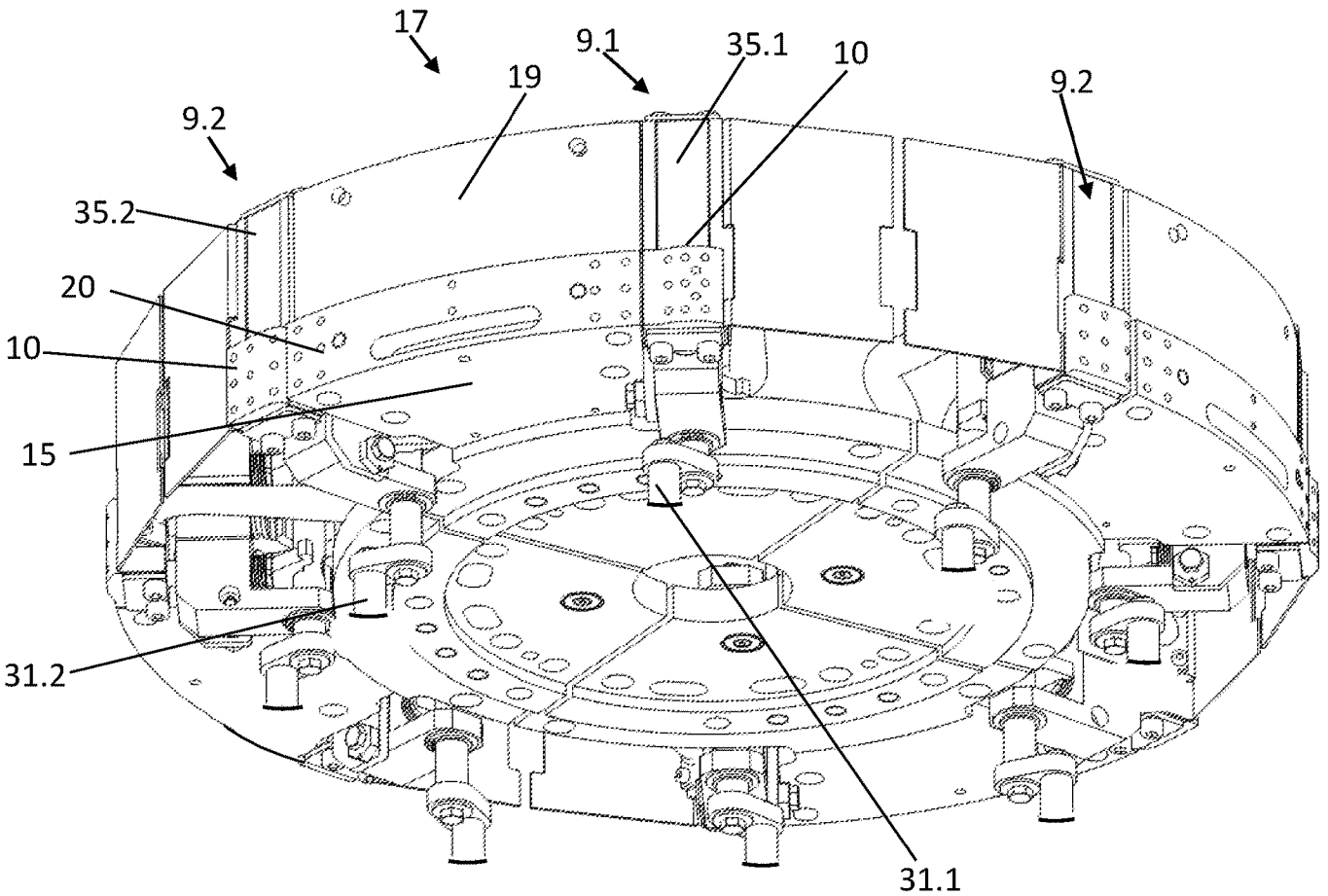
FIG. 3 shows the drum of FIG. 2 from below.

As can be seen in FIG. 3, each segment 17 comprises a carrier plate 15 that forms a segment of a pitch circle that is centered at a vertical shaft 16 that coincides with the drum's axis TA and is guided through a fixed base 40, as shown in FIG. 2. A motor 18, which is secured to the base's underside, drives the shaft 16, thereby rotating the drum 6 in the second direction B. Embodiments include those in which the motor 18 is an electric motor, such as a servomotor. A wall section 19 forms part of the drum's circumferential wall. The wall section 19 extends between the front and rear holders 9.1, 9.2.

The wall section 19 has suction openings 20 formed therethrough to connect to vacuum chambers 21 that lie radially inward from the wall section 19. Suction lines 22, shown in FIG. 6, couple to a rotary connection and connect the vacuum chambers 21 to a central vacuum source.

Each of the front and rear vacuum holders 9.1, 9.2 includes an associated vacuum pad 35.1, 35.2. The vacuum pad 35.1, 35.2 is a strip that extends in a direction parallel to the drum's axis TA. Openings 10 in the vacuum pad 35.1 permit the ends of the label to be held by suction against the vacuum pad 35.1, 35.2. The vacuum pads 35.1, 35.2, like the holders 9.1, 9.2, switch between the radially-outer working position AP and the radially-inner maintenance position WP. When in the working position AP, the vacuum pads 35.1, 35.2 project radially outward from the wall section 19. This promotes application of glue only to the label's ends when the label is brought to the gluing station 11.

As shown in FIG. 7, the vacuum pads 35.1, 35.2 are hermetically secured to corresponding front and rear nozzle bodies 36.1, 36.2 to ensure a connection between the vacuum openings 10 provided at the respective vacuum pads 35.1, 35.2 and the suction lines 22.

Figure 6:
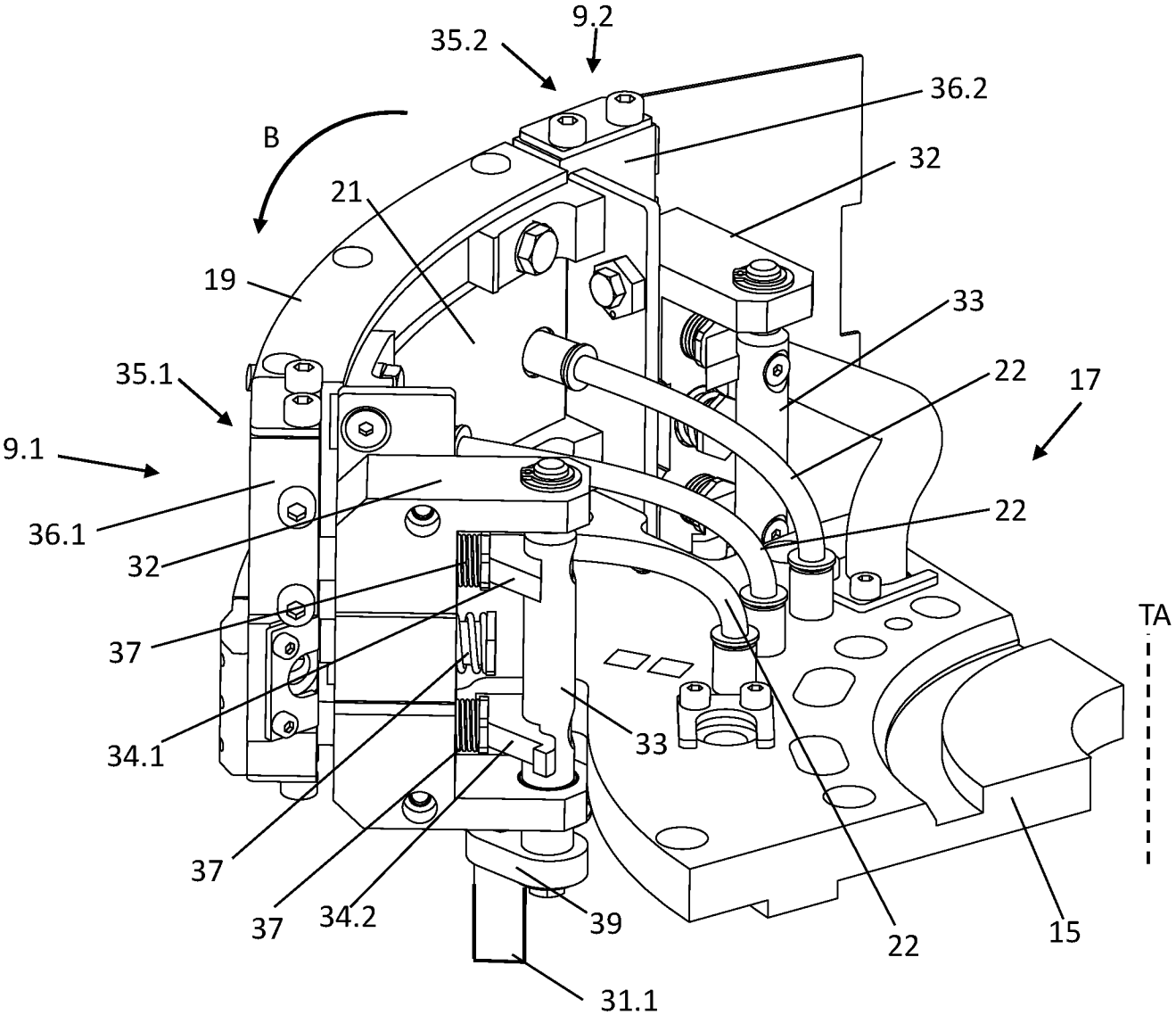
FIG. 6 is an isometric view of a segment of the drum shown in FIG. 2.

As shown in FIG. 6, the rotational switch 30.1, 30.2 comprises end limbs that extend radially-inward to form a U-shaped carrier. A rotatable pivot axis 33 extends between the side limbs along a direction parallel to the drum axis TA. Two rocker levers 34.1, 34.2 are securely arranged along the pivot axis 33 and spaced apart along the pivot axis 33.

Figure 8:
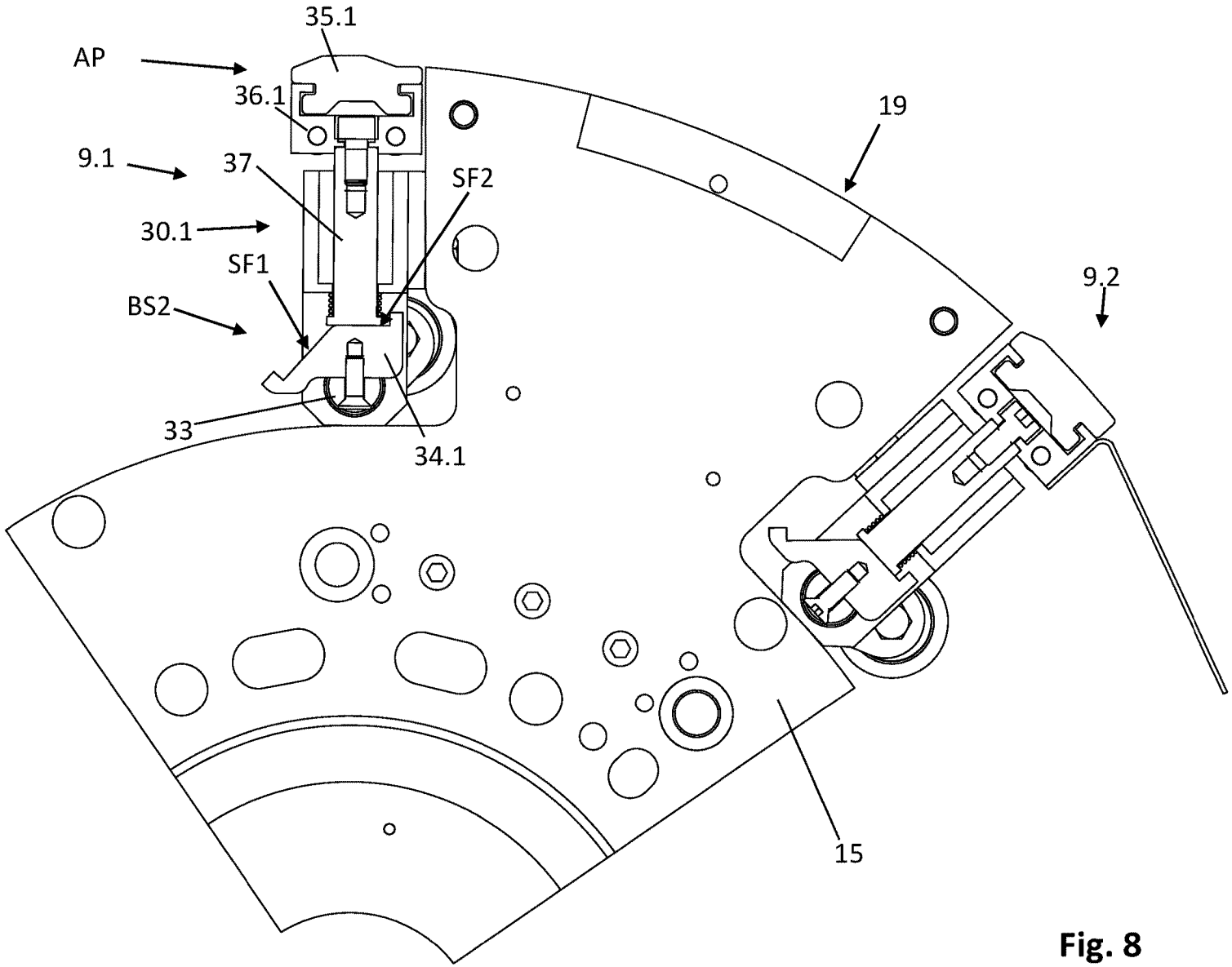
FIG. 8 is a top view of the segment shown in FIG. 6 with the front vacuum holder in its working position.
Figure 9:
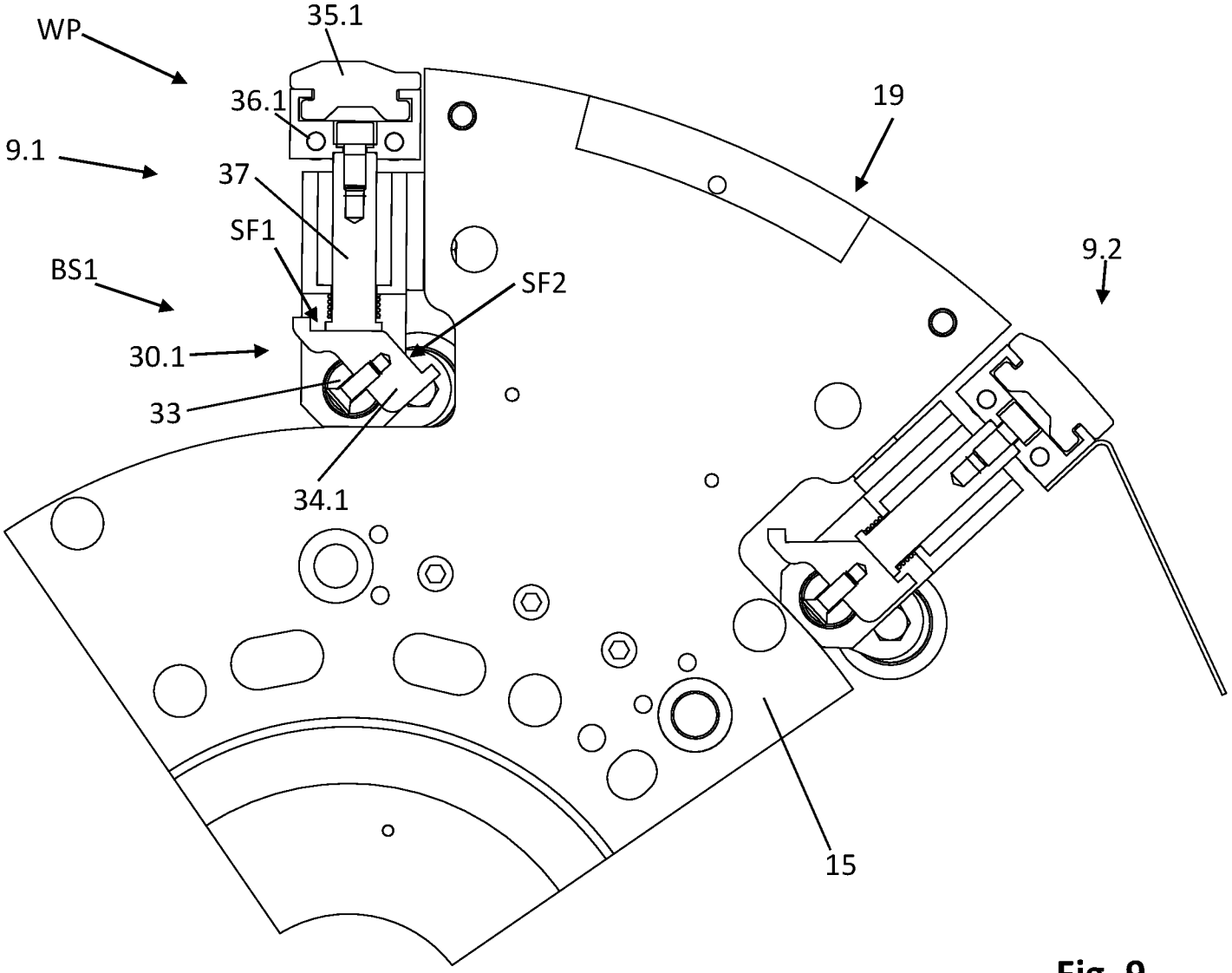
FIG. 9 is a top view of the segment shown in FIG. 6 with its front vacuum holder is located in its maintenance position.
Figure 10:
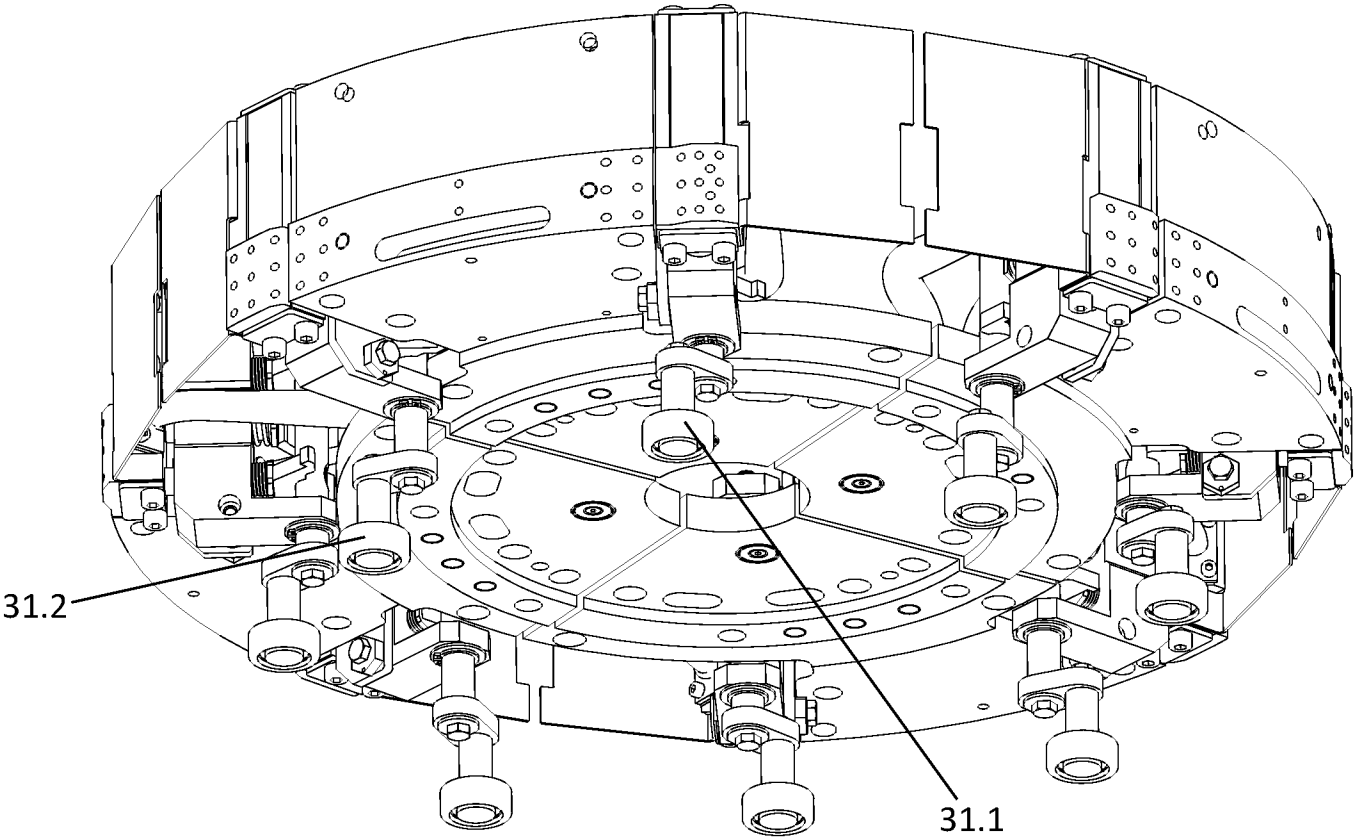
FIG. 10 shows a view from below the vacuum drum of FIG. 2 in which the switch actuators 31.1, 32.2 are configured as switching rollers.

As shown in FIG. 8, each rocker lever 34.1, 34.2 comprises first and second switching surfaces SF1, SF2. Each switching surface SF1, SF2 interacts with a first end of a punch 37 that is biased by spring force. The punch 37 is guided to be displaceable in an axial direction along a side limbs of the U-shaped carrier element 32. The punch's second end connects securely to the corresponding front and rear nozzle bodies 36.1, 36.2.

The rocker levers 34.1, 34.2 pivot to-and-fro between the first and second operating positions BS1, BS2. The first operating position BS1 is formed at the first switching surface SF1 and the second operating position BS2 is formed at the second switching surface SF2 of the rocker levers 34.1, 34.2.

Switching the rocker levers 34.1, 34.2 into the first operating position BS1 holds the front and rear vacuum pads 35.1, 35.2 in the maintenance position WP. Switching the rocker levers 34.1, 34.2 into the second operating position BS2 holds the vacuum pads 35.1, 35.2 in the working position AP.

As shown in FIGS. 6 and 7, a lever 39 couples the pivot axis 33 to the switch element 31.1, 31.2. A stationary switch 41.1, 41.2 is thus able to use the lever 39 to pivot a corresponding switch actuator 31.1, 31.2 to rotate the pivot axis 33. This, in turn, causes the switching surfaces SF1, SF2 at the rocker levers 34.1, 34.2 to switch, thus moving the punch 37 outward or inward. This, in turn, causes a switch between the first and second operating positions BS1, BS2. Moreover, the switch is bistable. After having been switched into a new operating position BS1, BS2, that operating position remains selected until another switching event occurs. The front and rear rotational switches are therefore "self-holding."

The vacuum drum 6 therefore represents a bistable system that remains in either the inner maintenance position WP or the outer working position AP without the need for the switch actuators 31.1, 31.2 to be held or guided by the switching device 41.1 . . . 41.3. It is therefore only necessary for switching to occur when some change makes switching necessary, such as when gaps occur in the container flow or upon reinstatement of continuous container flow. This reduces the number of switching procedures that would otherwise have to be carried out for large gaps in which many containers are missing.

In some embodiments, as shown in FIG. 7, the distance between the base 40 and a free end of a front switch actuator 31.1 of a front vacuum holder 9.1 differs from the distance between the base 40 and the free end of a rear switch actuator 31.2 of a rear vacuum holder 9.2. In FIG. 7, the free ends of the front switch actuators 31.1 of the associated front vacuum holders 9.1 are in a first horizontal plane that is at a first height H1 above the base 40 and the free ends of the rear switch actuators 31.2 of the rear vacuum holders 9.2 are in a second horizontal plane that is at a second height H2 above the base 40, where the first height exceeds the second height. As a result, the free ends of the front switch actuators 31.1 are above the free ends of the rear switch actuators 31.2.

Figure 4:
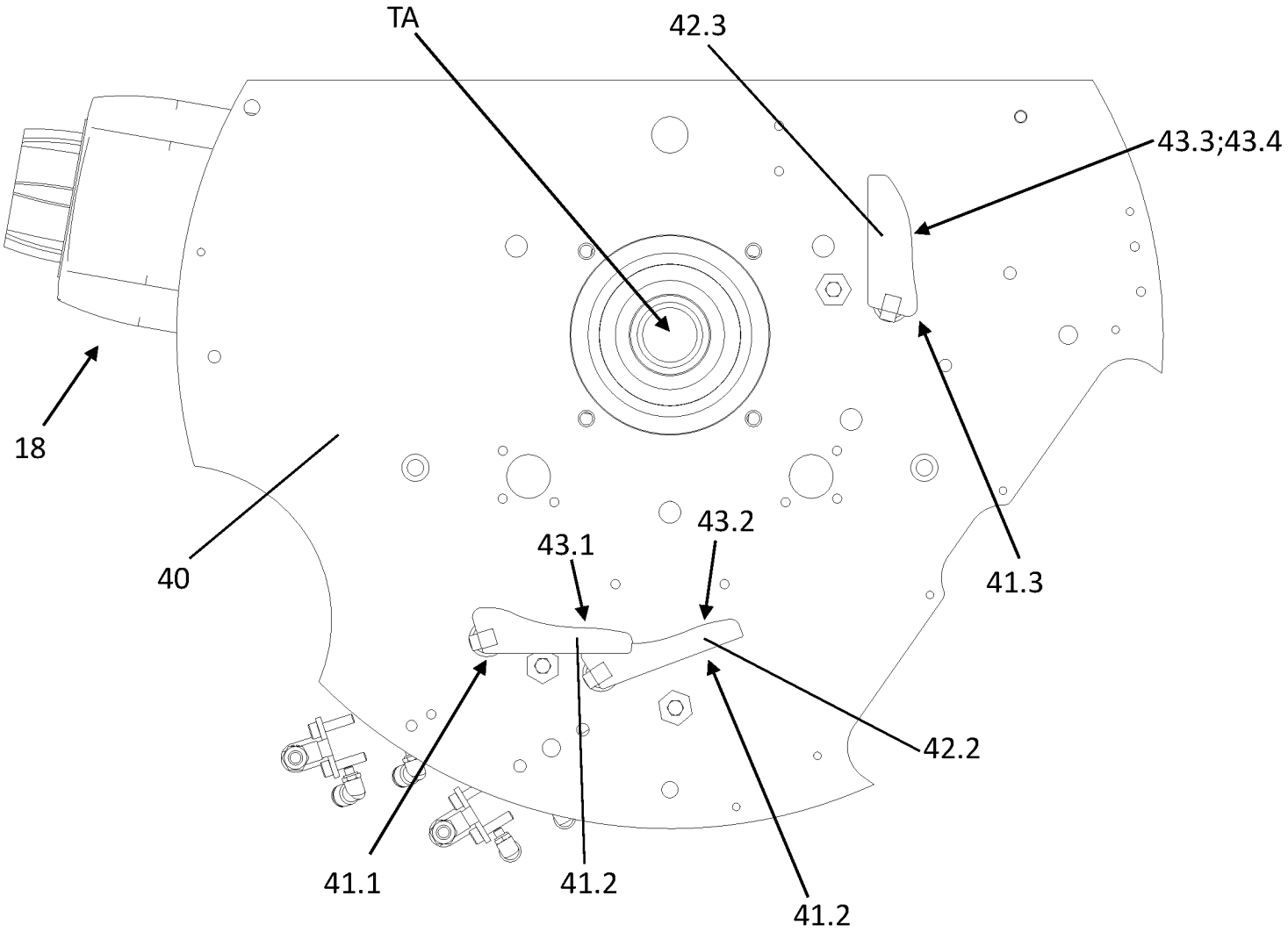
FIG. 4 is a top view from above a carrier plate of the drum shown in FIG. 3.
Figure 5:
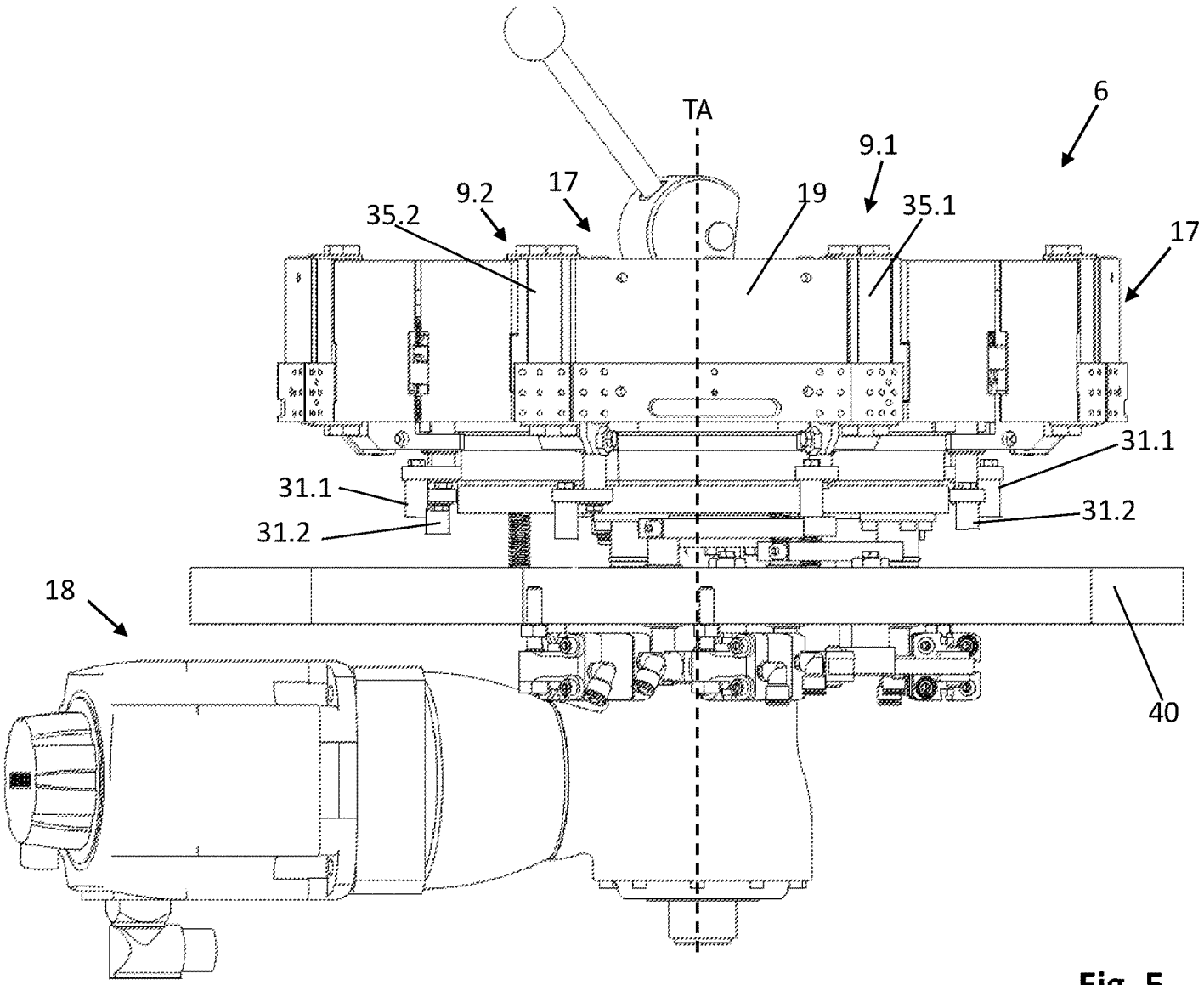
FIG. 5 is a side view of the drum shown in FIG. 4.

To initiate switching of the front and/or rear rotational switch 30.1, 30.2 between first and second stationary operating positions BS1, BS2, the respective switch actuators 31.1, 31.2 are be brought into working engagement with at stationary switches 41.1 . . . 41.3, as shown in FIGS. 2 and 4.

As shown in FIG. 4, each stationary switch 41.1 . . . 41.3 comprises a switchable lever 42.1 . . . 42.3 with a control surface 43.1 . . . 43.4. Each control surface 43.1 . . . 43.4 initiates a switching movement of a rotational switch 30.1, 30.2 by way of their respective switch actuators 31.1, 31.2. Each switchable lever 42.1 . . . 42.3 pivots relative to the respective switch actuator 31.1 . . . 31.2 in such a way that its control surface 43.1 . . . 43.4 initiates a switchover movement between operating position BS1, BS2 by interacting with the corresponding rotational switch 30.1, 30.2.

Some embodiments feature first, second, and third stationary switches 41.1, 41.2, 41.3 as shown in FIG. 4. In such embodiments, the first switching device 41.1 comprises a first pivotable lever 42.1 with a first control surface 43.1, the second switching device 41.2 comprises a second pivotable lever 42.2 with a second control surface 43.2, and the third switching device 41.3 comprises a third pivotable lever 42.3 with third and fourth control surfaces 43.3, 43.4. The various pivotable levers 42.1, 42.2, 42.3 pivot independently of each other.

The first stationary switch 41.1 presses the front switch actuator 31.1 of a corresponding front vacuum holder 9.1 radially inward in the direction of the drum's axis TA. This switches the front rotational switch 30.1 into the first operating position BS1, thus placing the front vacuum holder 9.1 into the maintenance position WP. If, by a further rotation about the drum axis TA, the front switch actuator 31.1 now disengages from the first control surface 43.1 of the first switching device 41.1, the front vacuum holder 9.1 holds itself in the first operating position BS1, This places the first control surface 43.1 of the first switching device 41.1 at the first height H1.

The second stationary switch 41.2 presses the rear switch actuator 31.2 radially-inward towards the drum's axis TA, thereby switching the rear rotational switch 30.2 into the first operating position BS1. This places the rear vacuum holder 9.2 is located into its maintenance position WP.

A further rotation about the drum's axis TA disengages the rear switch actuator 31.2 from the second control surface 43.2. The rear vacuum holder 9.2 nevertheless holds itself in the first operating position BS1. The second control surface 43.2 of the second switching device 41.2 is thus at the second height H2.

The third stationary switch 43.1 is configured such that the third and fourth control surfaces 43.4, 43.4 exert a radially-outward force. This causes the front and rear rotational switches 30.1, 30.2 to switch into the second operating position BS2, in which the vacuum holders 9.1, 9.2 are in the working position AP.

As the drum rotates further, the front and rear vacuum holders 9.1, 9.2 disengage from the third and fourth control surface 43.3, 43.4. Nevertheless, the front and rear vacuum holders 9.1, 9.2 hold themselves in the second operating position BS2. The third and fourth control surfaces 43.3, 43.4 are at the first and second heights H1, H2 respectively.

The invention has been described heretofore by way of exemplary embodiments. It is understood that numerous alterations and derivations are possible without thereby departing from the underlying inventive concept of the invention. The claims are deemed to be a constituent part of the description.

The invention claimed is:

1. An apparatus comprising a drum for a labelling unit of a labelling machine for labeling containers, said drum being a vacuum drum that comprises a drum surface, said drum surface being a circumferential surface, a drum axis, and a vacuum-holder pair that rotates with said drum about said drum, wherein said vacuum-holder pair comprises front and rear holders provided at said surface and offset relative to one another along said rotation direction, said holders being vacuum holders, wherein said front and rear holders hold corresponding front and rear ends of a label as said label is held against said drum's surface, wherein each of said front and rear holders comprises a rotational switch that can be switched between two operating positions said rotational switch being a bistable switch comprising a switch actuator that causes said rotational switch to switch between said operating positions, wherein said rotational switch, after having been switched into an operating position, remains in said operating position, wherein, said rotational switch switches said front and rear vacuum holders between first and second operating positions, wherein said first operating position is a radially-inner position in which said pair is movable without contact past a gluer that is next to said drum, wherein said second operating position is a radially-outer position in which said vacuum holder pair enables said gluer to apply glue to said label, and wherein said switch actuator engages a stationary switch to initiate a switch between said operating positions.

2. The apparatus of claim 1, wherein said drum further comprises segments arranged around a drum axis, wherein vacuum-holder pair is one of a plurality of vacuum-holder pairs, each of which is one of said segments, wherein said front and rear vacuum holders of each of said vacuum-holder pairs are switchable separately from each other between said operating positions using corresponding rotational switches thereof.

3. The apparatus of claim 1, further comprising a front pad and a rear pad, said pads being vacuum pads, wherein said front pad is disposed at said front holder, wherein said rear pad is disposed at said rear holder, wherein said front pad is configured to switch between said radially-outer position and said radially-inner position by said front holder's rotational switch, and wherein said rear pad is configured such as to be switched between said outer working position and said inner maintenance position by said rear holder's rotational switch.

4. The apparatus of claim 1, wherein said rotational switch comprises a U-shaped carrier, wherein said carrier comprises side limbs, a rotatable pivot axis extending between said side limbs along a direction parallel to said drum axis, and at least two rocker levers arranged along said pivot axis, wherein movement of said rocker levers causes said rotational switch to change state.

5. The apparatus of claim 1, wherein said rotational switch further comprises a punch that is biased by a spring force and that is guided to move axially, wherein said punch has a first end that has a sealed connection with a nozzle body on which a vacuum pad is arranged and a second end that engages a rocker lever.

6. The apparatus of claim 1, wherein said rotational switch further comprises a pivot axis and rocker levers, wherein said rocker levers are arranged at said pivot axis to pivot between said operating positions, wherein each of said rocker levers comprises first and second switching surfaces, wherein said first switching surface engages said pivot axis in said first operating position, and wherein said second switching surface engages said pivot axis in said second operating position.

7. The apparatus of claim 1, wherein said rotational switch comprises rocker levers and vacuum pads, wherein said rocker levers switch between said first and second operating positions, wherein said first operating position results in said vacuum pad being retained in a working position, and wherein said second working position results in said vacuum pad being retained in a maintenance position.

8. The apparatus of claim 1, wherein said rotational switch comprises a pivot axis, a punch, and rocker levers having switching surfaces, wherein said punch moves in a radial direction relative to said drum, wherein movement of said punch engages said switching surfaces to cause said rotational switch to transition between said operating positions, wherein said stationary switch initiates pivoting of said switch actuator to permit said movement of said punch.

9. The apparatus of claim 1, further comprising a base, wherein said switch actuators comprise free ends, wherein said free ends for switch actuators of front and rear holders lie in different horizontal planes at different heights above said base.

10. The apparatus of claim 1, wherein said stationary switch comprises a pivotable lever having a control surface for engaging said actuator to initiate switching of said rotational switch.

11. The apparatus of claim 1, wherein said stationary switch is one of a plurality of stationary switches, wherein each of said stationary switches comprises a pivotable lever having at least one control surface, and wherein at least one of said pivotable levers comprises two control surfaces.

12. The apparatus of claim 1, wherein said stationary switch is configured to use a control surface thereof to press said switch actuator radially inward, thereby initiating transition of said rotational switch into said radially-inner position.

13. The apparatus of claim 1, wherein said rotational switch is a rotational switch of said rear holder, wherein said stationary switch is configured to use a control surface thereof to press said switch actuator of said rotational switch radially inward to initiate transition of said rotational switch into said radially-inner position.

14. The apparatus of claim 1, wherein said stationary switch is one of at least three stationary switches, among which is a third stationary switch having first and second control surfaces, wherein said third stationary switch is configured to press said actuator radially away from said drum axis to initiate transition of said rotational switches into said radially-outer position.

15. The apparatus of claim 1, wherein said switch actuator comprises a bolt.

16. The apparatus of claim 1, further comprising a labeling machine for labeling containers with a roll-fed label, said labeling machine comprising said drum.

17. The apparatus of claim 1, wherein said switch actuator comprises a roller.

18. The apparatus of claim 1, wherein said switch actuator comprises a tag.

19. The apparatus of claim 1, wherein said switch actuator comprises a sleeve.

20. The apparatus of claim 1, wherein said switch actuator comprises a freely-rotating roller.

* * * * *